United States Patent [19]

Masse et al.

[11] Patent Number: 4,905,213

[45] Date of Patent: Feb. 27, 1990

[54] MEDICATION REMINDER

[76] Inventors: Viola H. Masse, 13300 E. Los Coches Rd., El Cajon, Calif. 92021; Angus R. Colson, Jr., 14160 Myrtle St., Jamul, Calif. 92035

[21] Appl. No.: 280,568

[22] Filed: Dec. 6, 1988

[51] Int. Cl.[4] ..... G04C 17/00; G04B 47/00

[52] U.S. Cl. ..... 368/10; 368/69; 368/74; 368/223

[58] Field of Search ..... 368/28, 29, 72–74, 368/82, 239–240, 185–187, 250, 251, 246, 261; 340/309.15, 309.4

[56] References Cited

U.S. PATENT DOCUMENTS

| | | | |
|---|---|---|---|
| 3,733,803 | 5/1973 | Hiraga et al. | 368/188 |
| 4,222,010 | 9/1980 | Meisner et al. | 368/188 |
| 4,253,177 | 2/1981 | Hafner | 368/187 |
| 4,257,115 | 3/1981 | Harise et al. | 368/251 |
| 4,272,836 | 6/1981 | Tamaru et al. | 368/201 |
| 4,338,681 | 7/1982 | Rapp et al. | 368/72 |
| 4,362,398 | 12/1982 | Jackson | 368/240 |
| 4,385,841 | 5/1983 | Kramer | 340/309.4 |
| 4,432,652 | 2/1984 | Munekata et al. | 368/74 |

*Primary Examiner*—Vit W. Miska

*Attorney, Agent, or Firm*—Henri J. A. Charmasson

[57] ABSTRACT

A multiple-alarm clock with an electronic digital circuitry and a large liquid-crystal screen displaying a simulated-conventional clock face. A series of push-buttons located on the periphery of the clock face are used to quickly program multiple alarm times. The same push-buttons can also be used to set the clock to the time of the day. The device is packaged in a wallet-sized housing, and is battery-powered for carrying convenience. The general appearance of the clock, the convenience of the alarm and time setting buttons are designed to facilitate this use by elderly persons and individuals with limited dexterity.

13 Claims, 4 Drawing Sheets

MEDICATION REMINDER

FIELD OF THE INVENTION

This invention relates to timepieces, and more specifically to digital clock and alarm devices.

BACKGROUND OF THE INVENTION

Hearing loss, impaired vision, limited dexterity and most critically, forgetfulness are the normal consequences of old age. Elderly persons can become easily confused when confronted by situations requiring complex cognition or action. This has considerable impact on that person's ability to exercise reliable self-care.

Illness caused by accidental drug misuse or abuse is estimated to happen at least once to 80 percent of all senior adults, with 20 percent of all senior adults requiring hospitalization due to accidental drug misuse. It has been reported that 125,000 patients affected with cardio-vascular disease die each year due to non-compliance with prescriptions. High among the various aspects of non-compliance to prescriptions is the failure to follow prescribed timing and amount of drug intake.

The United States population is experiencing a dramatic change in its demographic profile with a steady increase of persons aged sixty-five or older in relation to the total population. The percentage of such elderly persons will increase from 9.8 percent to 18 percent by the year 2030, by which time the elderly population will reach 55,000,000 individuals.

One of the factors contributing the most to drug misuse among elderly persons is the total lack, on the market, of a reliable, easily affordable and easy to use timepiece which could be used as a medicine-taking time reminder. A conventional alarm clock with a single alarm time-setting capability and twelve hour programming capability cannot meet the need of a cardio-vascular patient who must take a variety of drugs at different times of the day and night. Electronic digital timepieces offer a great range of programming capability; but their computer-age complexity and unconventional setting methods keep them beyond the abilities of most senior citizens. While sophisticated, programmable, multi-alarm devices have proposed in the past, they appear to be designed for the young generation whose members feel at home with computer technology. There is considerable resistance among many senior citizens to computer-type devices with their digital read-outs, multi-function switches or keyboards and miniature interfaces. The setting of a conventional digital wristwatch or bedside digital clock can be a challenge to somebody who did not grow up in a computer-oriented society. There is an acute need for a programmable timepiece which offers greater programming functions than the conventional alarm clock, yet retains the feel and appearance of the conventional timepieces so that it can be easily and reliably set and used by older individuals and persons with limited dexterity.

SUMMARY OF THE INVENTION

The principal and secondary objects of this invention are to provide a programmable timepiece which may be used to preset a number of medicine-taking times over a relatively long period, but which retains the simplicity in looks and operation of conventional timepieces.

It is also an object of this invention to provide such a timepiece in a compact and portable configuration with some protection against misuse and inadvertent power disconnection.

These and other objects are achieved by this invention in the form of a multiple-alarm clock driven by an electronic digital circuitry, and featuring a large liquid-crystal screen which displays a simulation of a conventional clock face with moving hands and clearly marked hour numbers. Multiple alarms can be programmed by pushing one or more push-buttons located around the clock face. In an alternate embodiment of the invention, the same push-buttons can be used to preset the clock's hours and minutes. The clock face and setting buttons are large enough to allow easy use by elderly persons and persons with limited dexterity.

DESCRIPTION OF THE PREFERRED EMBODIMENT OF THE INVENTION

Figure 1:
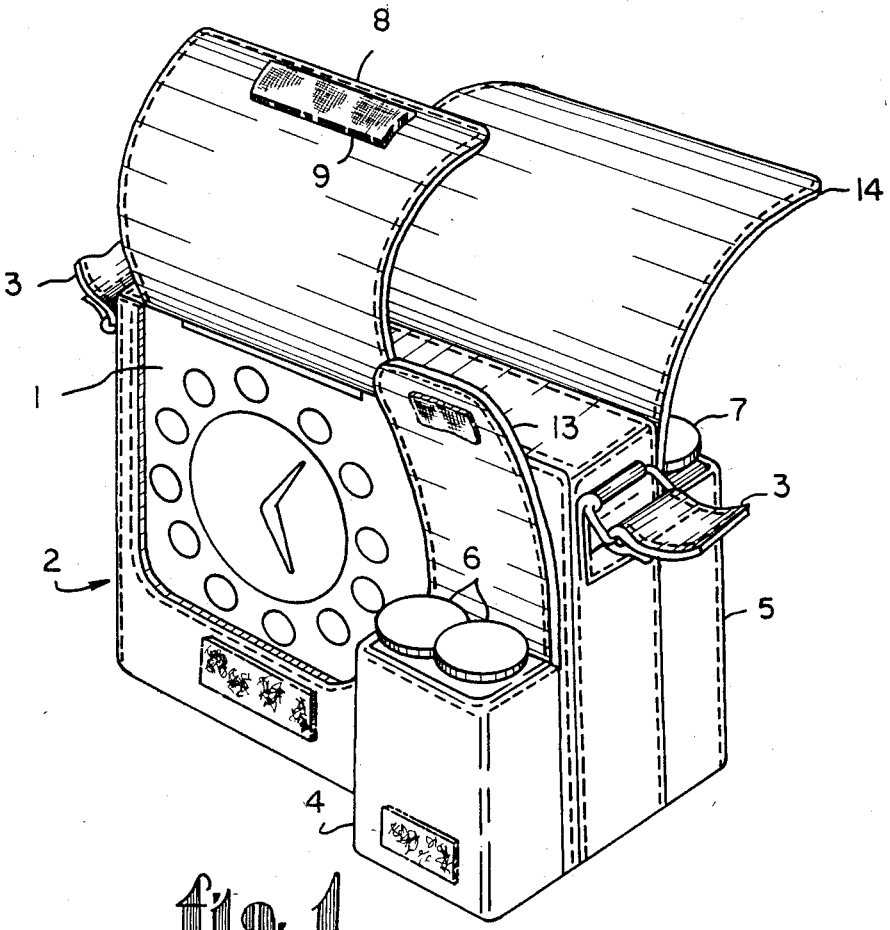
FIG. 1 is a perspective view of the preferred embodiment of the invention shown within a carrying case.

Referring now to the drawing, the preferred embodiment of the invention will be described beginning with the physical appearance of the device and its manual operation.

FIG. 1 illustrates a multi-alarm timepiece 1 housed in a satchel 2 for carrying convenience. The satchel has the general appearance and size of a small handbag with a shoulder-strap 3 shown only in part for clarity. The timepiece 1 occupies the center of the satchel which also has a small front pocket 4 and a larger back pocket 5. The pockets are sized and dimensioned to carry a variety of medicine vials 6 and 7. A flat cover 8 secured by cooperating hook-and-vane fastening strips 9 and 10 closes the cutout 11 in the front of the satchel through which the clock face 12 appears. Similar flaps 13 and 14 close the front and back pockets 4 and 5 respectively.

Figure 2:
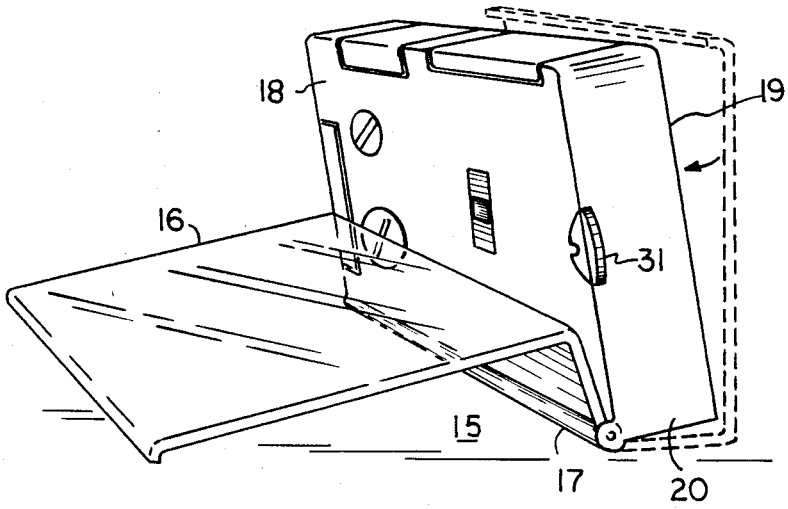
FIG. 2 is a back perspective view of the multi-alarm timepiece on a tabletop.

FIG. 2 illustrates the timepiece 1 without the satchel 2 and resting on a tabletop surface 15. A L-shaped, transparent cover 16 is hinged along the bottom edge 17 of the back face 18 of the timepiece. The transparent cover is shaped and dimensioned to cover the front face 19 and bottom 20 of the timepiece when it is rotated 270 degrees about its hinge from the position illustrated in FIG. 2. The transparent panel 16 serves first as a supporting brace when the timepiece is used on a tabletop as illustrated in FIG. 2, and secondly, as a protective cover when it is rotated against the front face where it snaps into place when the timepiece is being carried within or without the satchel 2.

Figure 3:
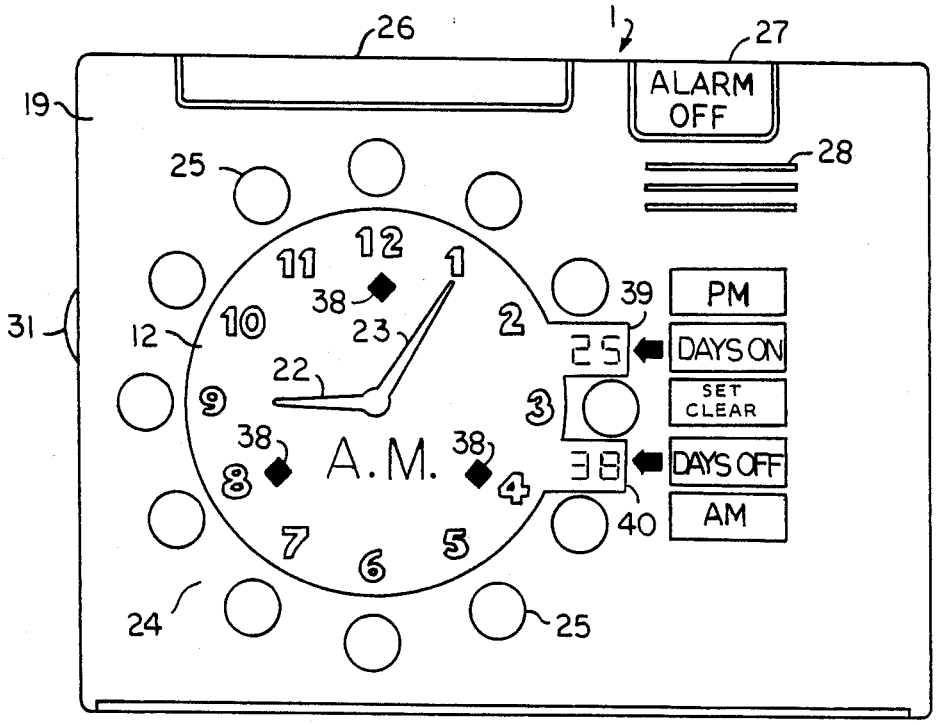
FIG. 3 is a front elevational view of the timepiece.

As shown in FIG. 3, the front panel of the timepiece 1 features a Liquid-Crystal Display (LCD) screen 21 which has the general appearance of a conventional clock face having at least twice the size of a conventional gentleman's wristwatch display. The hour numerals 1–12 are painted in bold characters over the face of the screen, but the clock hands 22 and 23 are electronically simulated on the screen through the internal circuitry. The background of the clock face 12 is also used to electronically display a variety of messages and indications as will be explained below. On the periphery 24 of the clock face, a series of 12 fingertip-sized buttons are placed in radial alignment with the twelve clock numerals. Five additional push-buttons labeled PM, DAYS ON, SET-CLEAR, DAYS OFF, and AM are clustered on the right side of the clock face 12. A low-wattage nightlight 26 is housed under a translucent cover along the upper edge of the front face 19 of the timepiece adjacent to an ALARM OFF push-button 27. A grid 28 covering an alarm buzzer completes the front face interface.

Figure 4:
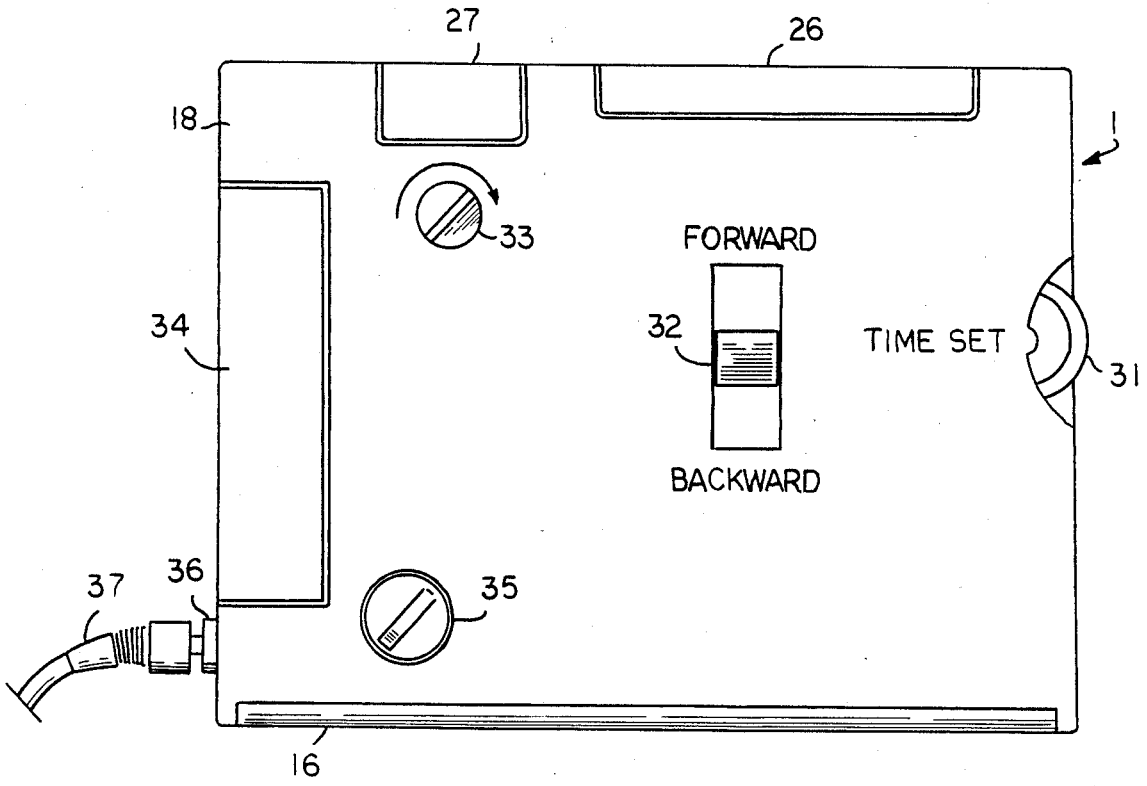
FIG. 4 is an elevational view of the timepiece.

FIG. 4 illustrates the backface 30 of timepiece. A thumbwheel switch 31 labeled TIME SET protrudes from the right edge of the backface. Turning this switch in either direction will either advance or back up the clock. This operation is immediately reflected by the position of the hands 22 and 23 on the clock face 12. The thumb-wheel switch 31 must first be depressed inward into engagement with the internal drive. The thumb-wheel switch rotates freely when not engaged without affecting the operation of the clock. This arrangement avoids inadvertent setting of the clock. A three-position slide switch 32 activates a quick stepping forward or backward of the clock by one hour. This switch can be conveniently used for resetting the clock after a change into or from daylight saving hours. The volume of the audio-alarm can be adjusted by means of a small knob 33. Batteries are housed under a cover 34 located along the left edge of the backface 30. A small button-type, backup battery 35 is housed in a covered receptacle nearby. A socket 36 receives the jack end of a power cord 37 which should be used when possible to save battery life.

Multiple alarm or medicine-taking reminding times are set by pushing in sequence, the SET button, either the AM or PM button, and one or more of the twelve peripheral buttons 25. As the peripheral buttons are pushed the alarm time-setting will be indicated by the appearance of diamond symbols 38 on the face of the clock 12 in line with the selected times. In the example illustrated in FIG. 3, the alarm has been set to ring every four hours, starting at 4:00 A.M. Pushing the SET button enables the alarm-setting modes for 10 seconds, after which the clock returns to its normal time of the day operating mode. If the SET-CLEAR button is pushed again during the 10-second period, the programmed alarm times are automatically cleared. The clock is designed to work on a twenty-four hour basis. The A of the AM/PM display shows in the lower part of the clock face 12 will change to a P when the clock reaches twelve noon. The ringing of the alarm is also subject to the setting of the DAYS ON-DAYS OFF buttons. Each of those two buttons controls a counter with the count displayed in one of the two digital windows 39 and 40 along the right edge of the clock face 12. These counters may be adjusted by first pushing the SET-CLEAR button, and touching, in sequence and in any order, the DAYS ON and/or DAYS OFF pushbuttons. The Counter and corresponding displays 39 or 40 will advance at the approximate rate of one count per second as long as the DAYS ON or DAYS OFF button is depressed.

It can now be seen that, thanks to its conventional clock face and simple-to-operate push-buttons, a number of alarm times can be preset according to a simple procedure.

Figure 5:
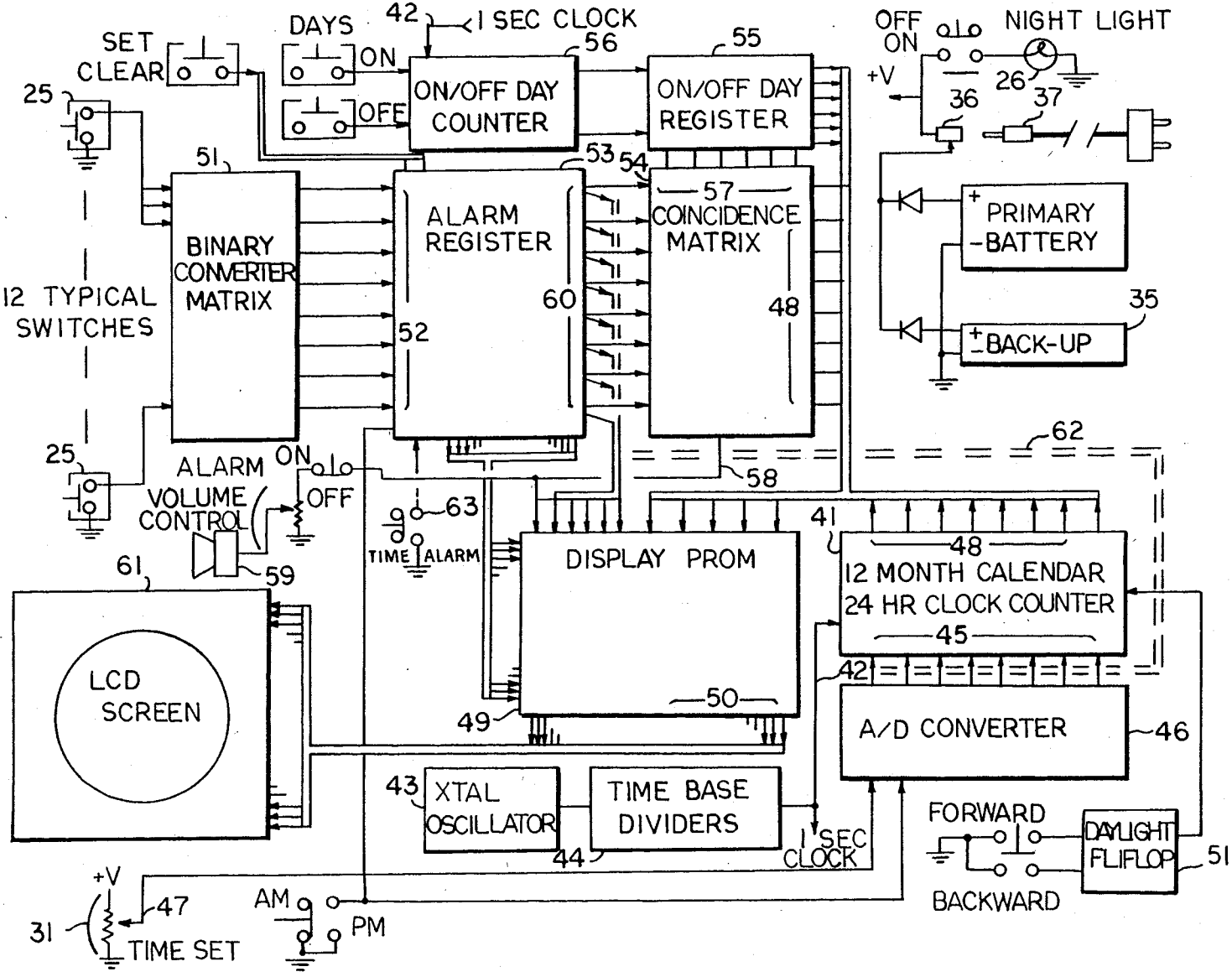
FIG. 5 is a block diagram of the internal circuitry.

The operation of the internal circuitry which controls the clock can best be understood with reference to the block diagram of FIG. 5. The heart of the timepiece is a 24-hour clock 12 month calendar counter unit 41 such as is found in common digital wristwatches. It is driven by a one-second clock pulse 42 derived from a time base constituted by a crystal oscillator 43 and a set of dividers 44. The digital clock unit 41 is set through parallel entry lines 45 to the various stages of its counters. Those lines are connected to the output of an analog-to-digital converter 46, the TIME SET thumb-wheel switch 31 drives a potentiometer 47 which provides the input to the converter 46 along with the setting of the AM/PM switches. The parallel output lines 48 from the various stages of the clock counter unit 41 are fed to a display Programmable Read Only Memory (PROM) 49 which is programmed to generate a series of drive signals 50 designed to simulate the progression of the clock hands 22 and 23. The stage of the clock counter unit 41 which corresponds to the one hour display is subject to correction according to the setting of the daylight flip-flop 51 which is set or reset by activation of the daylight saving switch on the back face of the timepiece.

The twelve signals generated by the twelve alarm setting push-buttons 25 are first converted to binary code by the binary converter matrix 51. The binary signals 52 corresponding to the push-buttons being sequentially depressed are fed into an alarm shift register 53. The various stages of the register 53 are periodically shifted so that the various alarm signals 52 are sequentially presented to a coincidence matrix 54 where they are compared to the output lines 48 of the digital clock counter 41. The coincidence matrix 54 also receives the output of the ON/OFF DAY register 55. This register stores the output of the ON/OFF DAY counter 56 which is activated by the DAYS ON and DAYS OFF push-buttons on the front face of the timepiece. When the coincidence matrix 54 recognizes a coincidence between the time indicated by the digital clock unit 41 and the time which has been programmed and is now stored in the alarm register 53, subject to the indications 54 provided by the ON/OFF DAY register 55, and alarm 58 signal is generated. Subject to the setting of the ALARM OFF switch and the volume control switch, the alarm signal activates a buzzer or horn 59. The shifted outputs 60 of the alarm register 53 are sequentially presented to the display PROM 49 which is also programmed to generate from those signals the codes necessary to drive the diamond-shaped indications of alarm-setting on the LCD screen which simulates the clock face 12.

It should be noticed that an alternate embodiment of the invention could be readily implemented in which the clock would be set by using the twelve push-buttons 25 instead of the thumb-switch 31. This can be done by feeding the output line 60 of the alarm register into the parallel setting input lines 45 of the digital clock counter unit as shown by the cable 62 drawn in dotted lines on FIG. 5. The additional TIME/ALARM switch 63 shown only in FIG. 5, would enable the entry of the time dialed on the push-buttons 25 into the clock counter unit 41. The twelve push-buttons 25 would be first used to set the hours, and the next push-button which is activated would set the minutes. The clock hands 22 and 23 will automatically align with the hour and minute buttons that have been depressed. The switch from hours to minutes setting would be done automatically by the clock without the operator having to activate an additional control.

It should also be noted that, although the circuitry described in this preferred embodiment of the invention uses discrete elements such as the binary converter matrix 51, the alarm register 53, the coincidence matrix 54, the ON/OFF register 55, and ON/OFF counter 56, the functions of those various elements could be similarly implemented using a programmable microprocessor. Such implementation would be well within the general skill of a person practicing the electronic arts.

While the preferred embodiment of the invention has been described, and alternate embodiments have been suggested, modifications can be made and other embodiments can be devised without departing from the spirit of the invention and the scope of the appended claims.

What is claimed is:

1. A multiple-alarm electronic clock for use by persons with limited dexterity which comprises:

an audio alarm signal generator;

an electronic digital clock circuit having the capacity to control multiple alarm settings and to drive said signal generator;

an electronic time display driven by said clock circuit, said display being formatted to simulate the progress of a minute hand and a hour hand over a conventional analog clock face having twelve peripheral hour marks, said time display having a diameter at least twice the size of a conventional wristwatch face;

twelve fingertip-sized programming push-buttons, each corresponding to a specific time of day, circumferentially positioned around the time display and in radial alignment with said hour marks;

means responsive to the activation of one or more of said push-buttons, for triggering said audio alarm signal generator when said electronic clock reaches a specific time of day corresponding to an activated push-button; and means alternately responsive to the activating of one or two of said push-buttons, for presetting said time display.

2. The clock claimed in claim 1, wherein said programming buttons are located on the periphery of said clock face.

3. The clock claimed in claim 2, which further comprises means for setting the time displayed by the clock in response to the activation of said buttons.

4. The clock claimed in claim 1, wherein said means for presetting said time display comprises means for selectively causing the push-buttons to designate hours or fractions of hours.

5. The clock claimed in claim 4, wherein said means for triggering the audio alarm signal generator comprises means for selectively causing the push-buttons to designate hours or fractions of hours.

6. The clock claimed in claim 4, wherein said time display is a liquid crystal display matrix.

7. The clock claimed in claim 5, which further comprises means for indicating said specific time of the day.

8. The clock claimed in claim 2, which further comprises means for setting the time displayed by the clock by means of an adjustable switch.

9. The clock claimed in claim 8, wherein said means for setting the clock comprise a potentiometer; and means for converting an analog signal generated by said potentionmeter into a digital code within said digital clock.

10. The clock claimed in claim 7, wherein said means for indicating includes means for lighting symbols on said electronic time display at locations corresponding to said specific time of the day.

11. The clock claimed in claim 1, which further comprises for selectively inhibiting said audio alarm generator during a period of successive days.

12. The clock claimed in claim 1, which further comprises means for discretely displaying ante-meridian and post-meridian times of the day.

13. The clock claimed in claim 1, which further comprises:

a wallet-sized enclosure having at least one planar face for housing the clock circuit, the alarm signal generator and said means;

said electronic time display being mounted on said face; and a carrying case sized and dimensioned to contain said enclosure and at least one medication vial.

* * * * *